United States Patent [19]

Stottlemyre

[11] 4,447,081

[45] May 8, 1984

[54] FENCE DOOR LATCH

[76] Inventor: Phillip D. Stottlemyre, P.O. Box 258, Bolivar, Mo. 65613

[21] Appl. No.: 347,985

[22] Filed: Feb. 11, 1982

[51] Int. Cl.[3] ..... E05C 17/36

[52] U.S. Cl. ..... 292/264; 292/277; 292/DIG. 13

[58] Field of Search ..... 292/264, 148, 184, 189, 292/141, 268-270, 272-274, 277, DIG. 13, 302, 341.15, 278, 304; 248/306, 307; 24/241 SL, 238, 24/201 A, 116 R

[56] References Cited

U.S. PATENT DOCUMENTS

| | | | |
|---|---|---|---|
| 2,430,343 | 11/1947 | Karwacki | 292/302 X |
| 3,292,960 | 12/1966 | Gustafson | 292/264 |
| 3,698,751 | 10/1972 | Moore | 292/264 |
| 4,254,975 | 3/1981 | Miller | 292/264 |

FOREIGN PATENT DOCUMENTS

| | | | |
|---|---|---|---|
| 226648 | 10/1958 | Australia | 292/264 |
| 287647 | 10/1968 | Australia | 292/264 |
| 69040 | 4/1949 | Denmark | 292/341.15 |
| 192175 | 10/1957 | Fed. Rep. of Germany | 292/302 |
| 331644 | 11/1935 | Italy | 292/264 |
| 1428960 | 3/1976 | United Kingdom | 292/189 |

*Primary Examiner*—Gary L. Smith
*Assistant Examiner*—R. Illich
*Attorney, Agent, or Firm*—Gravely, Lieder & Woodruff

[57] ABSTRACT

This application discloses a latch assembly for a fence gate or the like comprising a two piece relatively movable first assembly mountable on one wall of the fence and a second assembly having a flexible body fastened at one end to the gate and having a loop at the other end which is positioned over both pieces of the first assembly and is locked to the first assembly by a gravity forced movement of one of the pieces of said first assembly.

2 Claims, 5 Drawing Figures

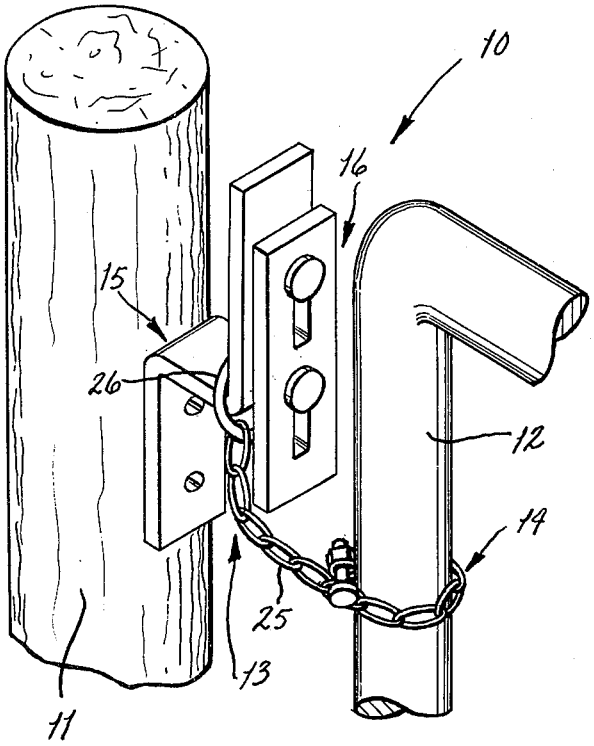
FIG. 1
FIG. 2
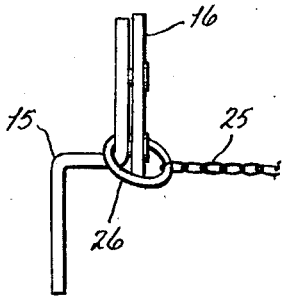
FIG. 3
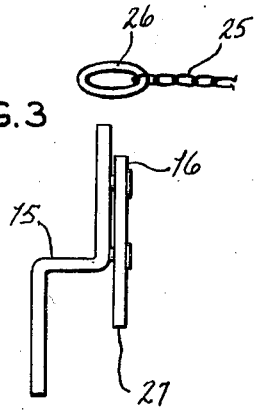
FIG. 4
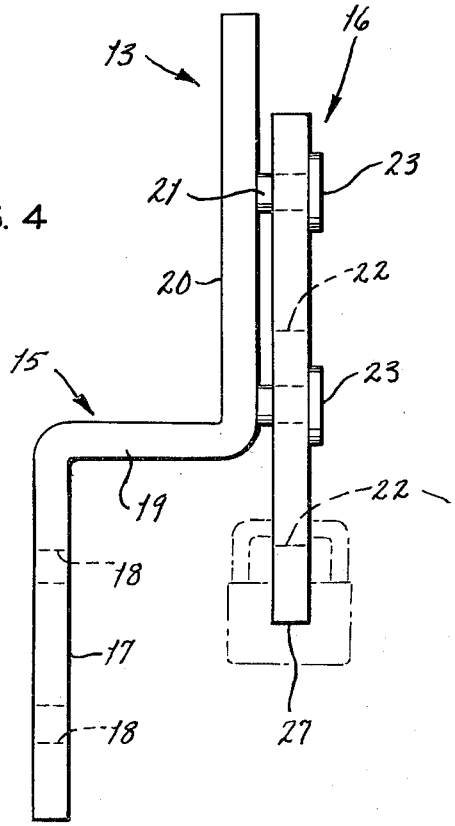
FIG. 5
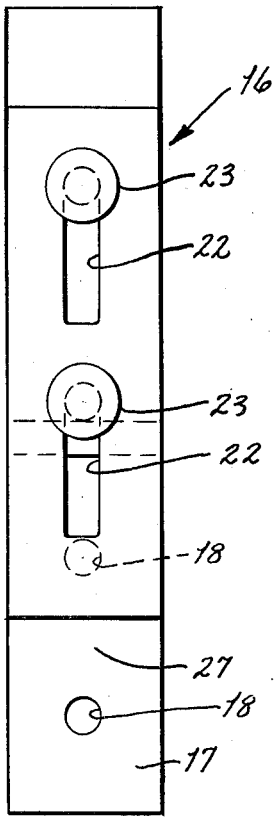

FENCE DOOR LATCH

BACKGROUND OF THE INVENTION

The present invention relates to a latching device and more particularly, to a gate latch for use with livestock enclosures having gates thereon.

The farmer or ranchers who raises livestock has long encountered the problem of providing a gate latch which will withstand severe weather, is easy to operate, and is difficult if not impossible for the livestock animal itself to operate.

It is well known in raising livestock and particularly horses, that such animals have an uncanny ability to manipulate an ordinary gate latch with their mouths and free themselves from their enclosure. This problem is particularly prevalent in both field gates and stall doors.

Various latches have been developed having spring loaded mechanisms whereby the latch keeper may be manipulated against the force of the spring to allow the gate or door to be latched and then later manipulated again in the unlatching process. However, these complicated spring loaded devices normally have a short use life in that the spring becomes rusty or after repeated use becomes weak and the latch fails.

There are many gravity operated keepers utilized in connection with latching mechanisms but for the most part, if these keepers are raised out of position, a gentle nudge on the gate or closure will cause the device to open. Therefore, if a horse or other animal raises the keeper and presses against the gate at the same time, the gate will automatically open, defeating the purpose of the latch.

Among the patents relating to the foregoing types of devices are Gustafson U.S. Pat. No. 3,292,960; Bowne U.S. Pat. No. 2,036,679; Winter U.S. Pat. No. 3,473,598 and Miller U.S. Pat. No. 4,254,975.

Accordingly one of the principal objects of the present invention is to provide a gate latching device which is easily operable by humans which being of difficult manipulability by animals, particularly horses.

Another object of this invention is to provide a relatively movable two piece keeper in combination with a chain and loop to releasably secure a gate to a fence post.

These and other objects and advantages will become apparent hereinafter.

The present invention comprises a keeper element formed of two relatively movable members in combination with a chain and loop element which loop is releasably and lockably engageable with the keeper element, such that when the slidable member of the keeper element is in locking position, the loop is fixedly retained to the keeper element, and when the keeper element is in release position, the loop is removable from the keeper element.

DESCRIPTION OF THE DRAWINGS

In the drawings, wherein like numbers refer to like parts wherever they occur,

FIG. 1 is a fragmentary perspective view of the present invention applied to a gate post and fence and in locked position;

FIG. 2 is a fragmentary elevational view showing the keeper element in unlocked position;

FIG. 3 is a fragmentary elevational view showing the chain loop removed from the keeper element;

FIG. 4 is a side elevational view of the keeper element; and

FIG. 5 is a front elevational view of the keeper element shown in FIG. 4.

DETAILED DESCRIPTION

FIG. 1 shows the fence door latch 10 mounted on a fence post 11 and a movable fence gate 12. The fence door latch 10 is formed by two elements. The first keeper element 13 is mounted on the fence post 11 and the second chain and loop element 14 is mounted on the gate 12.

The keeper element 13 in turn comprises two relatively slidable members 15 and 16. The mounting bracket member 15 is shown in greater detail in FIGS. 4 & 5 and comprises a mounting leg 17 provided with screw or bolt openings 18 for fastening the bracket 15 fixedly to the fence post 11. An intermediate section 19 connects the leg 17 to a free standing arm 20. The leg 17 and arm 20 are substantially parallel while the intermediate section 19 is perpendicular thereto.

The second member 16 of the keeper element 13 is vertically slidable relative to the mounting bracket 15 and is attached thereto by studs 21 which are welded or threaded to the bracket arm 20. The studs 21 reside in elongated slots 22 formed in the member 16. Heads 23 on the studs 21 in turn retain the second member 16 as a vertically slidable part of the keeper element 13.

The second element of the lach is the chain and keeper 14 and comprises a length of metal chain 25 which may be wire rope or other suitable flexible material, and a loop 26 at one end thereof. The chain 25 has one end securely fastened to the gate 12 and, as mentioned, a loop 26 on the free end.

The loop 26 is sized to slip over the arm 20 and the slidable member 16 when the member 16 is in its upward position as shown in FIG. 2. After the loop 26 has slipped over the lower edge 27 of the slidable member 16 while said member 16 is in its upward position, the member 16 is allowed to drop to its downward position as shown in FIG. 1 and it there traps the loop 26 in locked position.

The portion of the slide 16 which is below the intermediate member 19 when the slide 16 is in its lower position is greater than the inner diameter of the loop 26. Therefore the loop 26 cannot be slipped over the keeper element 13 when the slide member 16 is in its lowermost position. This prevents animals, particularly horses, from unlatching the gate 12. If it is desired to lock the gate 12 against human entry, a padlock (indicated by broken lines in FIG. 4) can be inserted through the lowermost slot 22 after the loop 26 has been positioned behind the slide 16.

Thus it is seen that the present invention achieves all of the objects and advantages sought therefor.

What is claimed is:

1. A latching assembly for a fence door comprising:

(a) a keeper assembly comprising a first element fastenable to a fence post and a second element secured to the first element and vertically slidable relative thereto; and (b) a second loop assembly comprising a flexible portion fastenable at one end to a gate and a loop member fastened to the other end and removably attachable to the keeper assembly;

(c) said first element having a leg attachable to a fence post, an uptanding arm having a free end, and an intermediate section connecting and spacing the leg and said arm, said second member being slidable along said arm between an upward position where the loop can be passed over the arm of the first member and the second member and around the lower edge of the second member and a lower position where the second member locks the loop to the keeper assembly.

2. A latching assembly for a fence door comprising:

(a) a keeper assembly comprising a first element fastenable to a fence post and a second element secured to the first element and vertically slidable relative thereto; and (b) a second loop assembly comprising a flexible portion fastenable at one end to a gate and a loop member fastened to the other end and removably attached to the keeper assembly;

(c) said second element being provided with elongated slots and the first element having parallel flanges connected and separated by an intermediate web, one of said flanges having means for attaching said element to a fence post, and the other flange having a free end, said other flange having headed studs thereon which reside in said elongated slots provided in the second element whereby the second element is slidable along said other flange from an upward position where the loop of the loop assembly can be passed over said second element to a lower position where the second element locks the loop to the keeper assembly, said second element having sufficient length when in the lower most position so that the portion thereof below the intermediate web is greater than the inside of the loop which extends below the intermediate web such that the loop cannot be slid around the lowermost end of the said second element.

* * * * *